US005110377A

United States Patent [19]

Yamamoto et al.

[11] Patent Number: 5,110,377

[45] Date of Patent: May 5, 1992

[54] PROCESS FOR PRODUCING PERMANENT MAGNETS AND PRODUCTS THEREOF

[75] Inventors: Hitoshi Yamamoto, Osaka; Masato Sagawa, Nagaokakyo; Setsuo Fujimura, Kyoto; Yutaka Matsuura, Ibaraki, all of Japan

[73] Assignee: Sumitomo Special Metals Co., Ltd., Osaka, Japan

[21] Appl. No.: 523,338

[22] Filed: May 14, 1990

Related U.S. Application Data

[60] Continuation of Ser. No. 239,381, Sep. 1, 1988, abandoned, which is a division of Ser. No. 85,226, Aug. 13, 1987, Pat. No. 4,826,546, which is a continuation of Ser. No. 706,399, Feb. 27, 1985, abandoned.

[30] Foreign Application Priority Data

| | | | |
|---|---|---|---|
| Feb. 28, 1984 | [JP] | Japan | 59-36923 |
| Feb. 28, 1984 | [JP] | Japan | 59-36924 |
| Feb. 28, 1984 | [JP] | Japan | 59-36925 |
| Feb. 28, 1984 | [JP] | Japan | 59-36926 |

[51] Int. Cl.[5] ..... H01F 1/053

[52] U.S. Cl. ..... 148/302; 420/83; 420/121; 75/244; 75/245; 75/246

[58] Field of Search ..... 148/302; 420/83, 121, 420/416, 435, 581, 583, 587; 75/244, 245, 246

[56] References Cited

U.S. PATENT DOCUMENTS

| | | | |
|---|---|---|---|
| 4,402,770 | 9/1983 | Koon | 420/435 |
| 4,601,875 | 7/1986 | Yamamoto et al. | 419/23 |
| 4,770,723 | 9/1988 | Sagawa et al. | 148/302 |
| 4,773,950 | 9/1988 | Fujimura et al. | 148/302 |
| 4,792,368 | 12/1988 | Sagawa et al. | 148/302 |
| 4,826,546 | 5/1989 | Yamamoto et al. | 148/103 |
| 4,859,255 | 8/1989 | Fujimura et al. | 148/302 |

FOREIGN PATENT DOCUMENTS

| | | |
|---|---|---|
| 0101552 | 7/1983 | European Pat. Off. . |
| 0106948 | 7/1983 | European Pat. Off. . |
| 0126802 | 9/1983 | European Pat. Off. . |
| 0134305 | 9/1983 | European Pat. Off. . |
| 0108474 | 5/1984 | European Pat. Off. . |
| 304891 | 11/1921 | Fed. Rep. of Germany . |
| 50-1397 | 1/1975 | Japan . |
| 52-50598 | 4/1977 | Japan . |
| 53-28018 | 3/1978 | Japan . |
| 54-76419 | 6/1979 | Japan . |
| 55-113304 | 9/1980 | Japan . |
| 55-132004 | 10/1980 | Japan . |
| 56-29639 | 3/1981 | Japan . |
| 56-47538 | 4/1981 | Japan . |
| 56-47542 | 4/1981 | Japan . |
| 56-65954 | 6/1981 | Japan . |
| 56-116844 | 9/1981 | Japan . |
| 57-141901 | 9/1982 | Japan . |
| 58-123853 | 7/1983 | Japan . |
| 59-219904 | 12/1984 | Japan . |
| 60-9104 | 1/1985 | Japan . |
| 60-31208 | 2/1985 | Japan . |
| 1266787 | 3/1972 | United Kingdom . |
| 2021147 | 11/1979 | United Kingdom . |
| 2100286 | 12/1982 | United Kingdom . |

OTHER PUBLICATIONS

"Precise Alloy Materials", Beijing Iron and Steel Institute, Mar., 1984, pp. 71–82 and 108–109.

(List continued on next page.)

*Primary Examiner*—John P. Sheehan

*Attorney, Agent, or Firm*—Burns, Doane, Swecker & Mathis

[57] ABSTRACT

A process for producing permanent magnet materials, which comprises the steps of:

forming an alloy powder having a mean particle size of 0.3–80 microns and composed of, in atomic percentage, 8–30% R (provided that R is at least one of rare earth elements including Y); 2–28% B, and the balance being Fe and inevitable impurities, sintering the formed body at a temperature of 900°–1200° C., subjecting the sintered body to a primary heat treatment at a temperature of 750°–1000° C., then cooling the resultant body to a temperature of no higher than 680° C. at a cooling rate of 3°–2000° C./min, and further subjecting the thus cooled body to a secondary heat treatment at a temperature of 480°–700° C.

35 MGOe, 40 MGOe or higher energy product can be obtained with specific compositions.

30 Claims, 1 Drawing Sheet

OTHER PUBLICATIONS

Croat et al, "Pr-Fe and Nd-Fe-based Materials: A New Class of High-Performance . . . ", J. Appl. Phys., 55(6), Mar. 15, 1984.
Chaban et al, "Ternary {Nd,Sm,Gd}-Fe-B Systems", Fed. Dopov. Akad.Nauk, URSR, SerA: Fig-Mat. Tekh, Nauki 1979(10) 873-876.
Leamy et al, "The Structure of Co-Cu-Fe-Ce Permanent Magnets", IEEE Trans. on Mag., vol. MAG-9, No. 3, Sep. 1973.
Melton et al, "An Electron Microscope Study of Sm-Co-Cu-Based Magnetic Materials . . . ", Jour. Appl. Phys., vol. 48(6), Jun. 1977.
Senno et al, "Magnetic Properties of Sm-Co-Fe-Cu Alloys for Permanent . . . ", Japan. J. Appl. Phys. vol. 14 (1975), No. 10.
J. J. Croat, "Preparation and Coercive Force of Melt-Spun Pr-Fe Alloys", Jour. Appl. Phys. Lett. 37(12), Dec. 15, 1980.
Koon et al, "Abstract: A New Class of Melt Quenched Amorphous Magnetic Alloys", J. Appl. Phys. 52(3), Mar. 1981.
Koon et al, "Rare—Earth Transition Metal Exchange Interactions in Amorphous . . . ", J. Appl. Phys. 53(3), Mar. 1982.
Koon et al, "Magnetic Properties of Amorphous and Crystallized . . . ", J. Appl. Phys. Lett. 39(10), Nov. 15, 1981.
Handbook on the Physics and Chemistry of Rare Earths, vol. 2, 1979, Chap. 16, Rhyne, "Amorphous Magnetic Rare . . . ".
Sagawa et al, "Permanent Magnet Materials Based . . . ", The Research Institute for Iron, Steel & Other Metals.
Nezu et al, "$Sm_2$ $(Co,Fe,Cu)_{17}$ Permanent Magnet Alloys with Additive . . . ", Magnetic & Electronic Materials Research Labs.
Sagawa et al, "New Material for Permanent Magnets on a Base of Nd and Fe", J. Appl. Phys. 55(6), Mar. 15, 1984.
Kabacoff et al, "Thermal and Magnetic Properties of Amorphous . . . ", J. Appl. Phys. 53(3), Mar. 1982.
Koon et al, Crystallization of FeB Alloys with Rare . . . ", J. Appl. Phys. 55(6), Mar. 15, 1984.
Croat et al, "High-Energy Product Nd-Fe-B Permanent Magnets", J. Appl. Phys. Lett. 44(1), Jan. 1, 1984.
Hadjipanayis et al, "New Iron-Rare-Earth Based Permanent Magnet Materials", J. Appl. Phys. Lett. 43(8), Oct. 15, 1983.
El Masry et al, "Magnetic Moments and Coercive Forces in the Hexagonal Boride . . . ", Magnetic Properties, Bd. 74 (1983).
Stadelmaier et al, "Cobalt-Free and Samarium Free Permanent Magnet . . . ", Dept. of Materials Eng. NC St. Univ., Sep. 1, 1983.
Herbst et al, "Relationships Between Crystal Structure . . . ", Physical Review B., 29, 4176 (1984).
Stadelmaier, "The Neodymium-Iron Permanent Magnet Breakthrough", MMPA Workshop, Jan. 1984.
Topp, "The Chemistry of the Rare-Earth Elements", Elsevier Pub. Co., 1965.
El Masry et al, "Substitution of Iron for Cobalt in Rare Earth . . . ", Dept. of Materials Eng., NC St. Univ., Feb. 1983.
El Masry et al, "Phase Equilibria in the Co-Sm-B System", Jour. of the Less-Common Metals, 96(1984) 165-170.
Robinson, "Powerful New Magnet Material Found", Science, vol. 233, Mar. 7, 1984.
Givord, "Magnetic Properties and Crystal Structure . . . ", Solid State Communications, vol. 50, No. 6, pp. 497-499, 1984.
Nagel et al, "Influence of Cu-Content on the Hard . . . ", IEEE Trans. on Mags., vol. MAG-14, No. 5, Sep. 1978.
Ojima et al, "Magnetic Properties of a New Type of Rare-Earth . . . ", IEEE Trans. on Mags., vol. MAG-13, No. 5, Sep. 1977.
Gupta et al, "Magnetization Process and Reversal . . . ", Jour. of Magnetism and Magnetic Materials 40 (1983) 32-36.
Chikazumi, "Physics of Magnetism", 497-499.
Mainichi Daily News, "Strongest Magnet Unveiled", Saturday, Jun. 4, 1983.
Japanese High Technology, "Request for New Magnetic Material . . . ", vol. 4, No. 5, Aug. 1984.
"Neomax—Neodymium-Iron-Magnet", Sumitomo Special Metals Co., Ltd.
Koo, "Partial Substitution of Sm with Neodymium . . . ", IEEE Trans. on Mags., vol. MAG-20, No. 5, Sep. 1984.

OTHER PUBLICATIONS

Givord, "Crystal Chemistry and Magnetic Properties . . . ", Report and proceedings of a Workshop in Burssels on Oct. 25, 1984.

Lee, "Hot-Pressed Neodymium-Iron-Boron Magnets", Appl. Phys. Lett. 46(8) Apr. 15, 1985.

Burzo, "Some New Results in the Field of Magnetism . . . ", Lecture, 2nd Int. Conf. on Mag. Mat., Poland, Sep. 1985.

Ormerod, "Processing and Physical Metallurgy . . . ", Report and Proceedings of a Workshop in Burssels on Oct. 25, 1984.

Handbook on the Physics and Chemistry of Rare Earths, vol. 2, Chap. 15, "Magnetostrictive $RFe_2$ Intermetallic Compounds".

Greedan et al, "An Analysis of the Rare Earth Contribution . . . ", Journal of Solid State Chemistry 6, 387-395 (1973).

Ray et al, "Easy Directions of Magnetization in Ternary . . . ", IEEE Trans. Mags., Sep. 1972.

Lee, "The Future of Rare Earth-Transition Metal Magnets . . . ", J. Appl. Phys. 52(3), Mar. 1981.

Ohashi et al, "Effects of Praseodymium Substitution on Precipitation Hardened Rare Earth Magnets", 493-501.

Handbook on the Physics and Chemistry of Rare Earths, vol. 2, Chap. 14, "Magnetic Properties of Intermetallic . . . ", 1979.

Neumann et al, "Line Start Motors Designed with Nd--Fe-B Permanent Magnets", 76-89.

Hadjipanaysis et al, "Electronic and Magnetic Properties . . . ", Jour. of Mag. and Mag. Mat., 21 (1980) 101-107.

Croat, "Magnetic Hardening of Pr-Fe and Nd-Fe Alloys . . . ", J. Appl. Phys. 53(4), Apr. 1982.

Japanese Publication, "Powder Metallurty-Applied Products (II)-Magnetic Materials".

Japanese Publication, "Magnetic Body Handbook".

Japanese Publication, "Hard Magnetic Material".

Japanese Publication, "Magnetic Materials".

Japanese Publication, "Magnetic Materials of the Modern Age".

Hadjipanayis et al, "Investigation of Crystalline Iron--Platinum Nickel and Amorphous . . . ", Final Technical Report, Mar. 15, 1983.

PROCESS FOR PRODUCING PERMANENT MAGNETS AND PRODUCTS THEREOF

This application is a continuation of application Ser. No. 239,381, filed Sep. 1, 1988, now abandoned which is a divisional of application Ser. No. 085,226 filed on Aug. 13, 1987, now U.S. Pat. No. 4,826,546 which is a continuation of application Ser. No. 706,399, filed on Feb. 27, 1985, now abandoned.

TECHNICAL FIELD

The present invention relates to rare earth-iron base permanent magnets or materials therefor in which expensive and resourceless cobalt is not used at all or contained in a reduced amount, and pertains to a process for producing same.

BACKGROUND

Permanent magnet materials are one of the very important electrical and electronic materials which are used in an extensive range covering from various electrical appliances for domestic use to the peripheral devices of large-scaled computers. With recent demands for electrical and electronic devices to reduce in size and increase in efficiency, it has increasingly been desired to improve the efficiency of the permanent magnet materials, correspondingly.

Typical permanent magnet materials currently in use are alnico, hard ferrite and rare earth-cobalt magnets. Recent uncertainty of supply of the raw material for cobalt has caused decreasing demand for the alnico magnets containing 20-30% by weight of cobalt. Instead, rather inexpensive hard ferrite is now taking that position for magnet materials. On the other hand, the rare earth-cobalt magnets are very expensive, since they contain as high as 50-65% by weight of cobalt and, in addition thereto, Sm that does not abundantly occur in rare earth ores. However, such magnets are mainly used for small magnetic circuits of high added value due to their much higher magnetic properties over those of other magnets. In order that the rare earth magnets are employed at low price as well as in wider ranges and amounts, it is required that they be freed of expensive cobalt or they contain only a reduced amount of cobalt, and their main rare earth metal components be light rare earth which abounds with ores. There have been attempts to obtain such permanent magnets. For instance, A. E. Clark found out that sputtered amorphous $TbFe_2$ had an energy product of 29.5 MGOe at 4.2° K., and showed a coercive force iHc of 3.4 kOe and a maximum energy product (BH)max of 7 MGOe at room temperature upon heat-treated at 300°-500° C. Similar studies were made of $SmFe_2$, and it was reported that an energy product of as high as 9.2 MGOe was reached at 77° K. However, these materials are all thin films prepared by sputtering, from which any practical magnets are not obtained whatsoever. It was also reported that the ribbons prepared by melt-quenching of PrFe base alloys showed a coercive force iHc of 2.8 kOe. Furthermore, Koon et al found out that, with melt-quenched amorphous ribbons of $(FeB)_{0.9}Tb_{0.05}La_{0.05}$, the coercive force iHc reached as high as 9 kOe upon annealed at 627° C., and the residual magnetic flux density Br was 5 kG. However, the (BH)max of the obtained ribbons is then low because of the unsatisfactory loop rectangularity of the demagnetization curves thereof (N. C. Koon et al, Appl. Phys. Lett. 39(10), 1981, 840-842 pages). L. Kabacoff et al have reported that a coercive force on the kOe level is attained at room temperature with respect to the FePr binary system ribbons obtained by melt-quenching of $(FeB)_{1-x}Pr_x$ compositions ($x=0-0.3$ in atomic ratio). However, these melt-quenched ribbons or sputtered thin films are not any practical permanent magnets (bodies) that can be used as such, and it would be impossible to obtain therefrom any practical permanent magnets. It comes to this that it is impossible to obtain bulk permanent magnets of any desired shape and size from the conventional melt-quenched ribbons based on FeBR and the sputtered thin films based on RFe. Due to the unsatisfactory loop rectangularity of the magnetization curves, the FeBR base ribbons heretofore reported are not taken as being any practical permanent magnets comparable to the conventionally available magnets. Since both the sputtered thin films and the melt-quenched ribbons are magnetically isotropic by nature, it is virtually almost impossible to obtain therefrom any magnetically anisotropic permanent magnets of high performance for the practical purposes.

SUMMARY OF THE DISCLOSURE

"R" generally represents rare earth elements which include Y.

One object of the present invention is to provide a novel and practical process for producing permanent magnet materials or magnets in which any expensive material such as Co is not used, and from which the disadvantages of the prior art are eliminated.

Another object of the present invention is to provide a process for producing novel and practical permanent magnets which have favorable magnetic properties at room or higher temperatures, can be formed into any desired shape and practical size, show high loop rectangularity of the magnetization curves, and can effectively use resourceful light rare earth elements with no substantial need of using rare resources such as Sm.

It is a further object of the present invention to provide a novel process for producing permanent magnet materials or magnets which contain only a reduced amount of cobalt and still have good magnetic properties.

It is a further object of the present invention to provide an improvement (i.e., reduction) in the temperature dependency of the Fe-B-R base magnetic materials and magnets.

It is still a further object of the present invention to provide a permanent magnet materials or magnets with a high performance such that has not been ever reported and a process for producing the same.

Other object will become apparent in the entire disclosure.

In consequence of intensive studies made by the present inventors to achieve these objects, it has been found that the magnetic properties, after sintering, of Fe-B-R alloys within a certain composition range, inter alia, the coercive force and the loop rectangularity of demagnetization curves, are significantly improved by forming (compacting) a powder having a specified particle size, sintering the formed body, and, thereafter, subjecting the sintered body to a heat treatment or a so-called aging treatment under the specific conditions (Japanese Patent Application No. 58(1983)-90801 and corresponding European Application now published EPA 126802). However, more detailed studies have led to findings that, by applying a two-stage heat treatment under more specific conditions in the aforesaid heat treatment, the coercive force and the loop rectangularity of demagnetization curves are further improved and, hence, variations in the magnetic properties are reduced.

More specifically, according to a first aspect, the present invention provides a process for producing a permanent magnet material comprising the steps of:

forming an alloy powder having a mean particle size of 0.3 to 80 microns and composed of, in atomic percentage, 8–30% R (provided that R is at least one of rare earth elements including Y), 2–28% B, and the balance being Fe and inevitable impurities (hereinbelow referred to as "FeBR base alloy", sintering the formed body at 900°–1200° C., subjecting the sintered body to a primary heat treatment at a temperature of 750°–1000° C., then cooling the resultant body to a temperature of no higher than 680° C. at a cooling rate of 3°–2000° C./min, and further subjecting the thus cooled body to a secondary heat treatment at a temperature of 480°–700° C.

The percentage hereinbelow refers to the atomic percent if not otherwise specified.

According to a second aspect of the invention, the FeBR base alloy further contains no more than 50% of cobalt partially substituted for Fe of the FeBR base alloy, whereby the Curie temperature of the resultant magnet material is increased resulting in the improved dependency on temperature.

According to a third aspect of the invention, the FeBR base alloy may further contain no more than the given percentage of at least one of the additional elements M (except for 0% M): no more than 9.5% V, no more than 12.5% Nb, no more than 10.5% Ta, no more than 9.5% Mo, no more than 9.5% W, no more than 8.5% Cr, no more than 9.5% Al, no more than 4.5% Ti, no more than 5.5% Zr, no more than 5.5% Hf, no more than 8.0% Mn, no more than 8.0% Ni, no more than 7.0% Ge, no more than 3.5% Sn, no more than 5.0% Bi, no more than 2.5% Sb, no more than 5.0% Si, and no more than 2.0% Zn, provided that in the case where two or more of M are contained the sum thereof is no more than the maximum given percentage among the additional elements M as contained.

Most of the additional elements M serve to improvement in the coercivity.

According to a fourth aspect of the invention, the FeBR base alloy further contains cobalt in the specific amount mentioned as the second aspect, and may contain the additional elements M in the specific amount mentioned as the third aspect of the present invention.

The foregoing and other objects and features of the present invention will become apparent from the following detailed description with reference to the accompanying drawing, which is given for the purpose of illustration alone, and in which:

FIG. 1 is a graph showing the relation between the amount of Co and the Curie point Tc (°C.) in an FeCoBR base alloy.

DESCRIPTION OF THE PREFERRED EMBODIMENTS OF THE INVENTION

Figure 1:
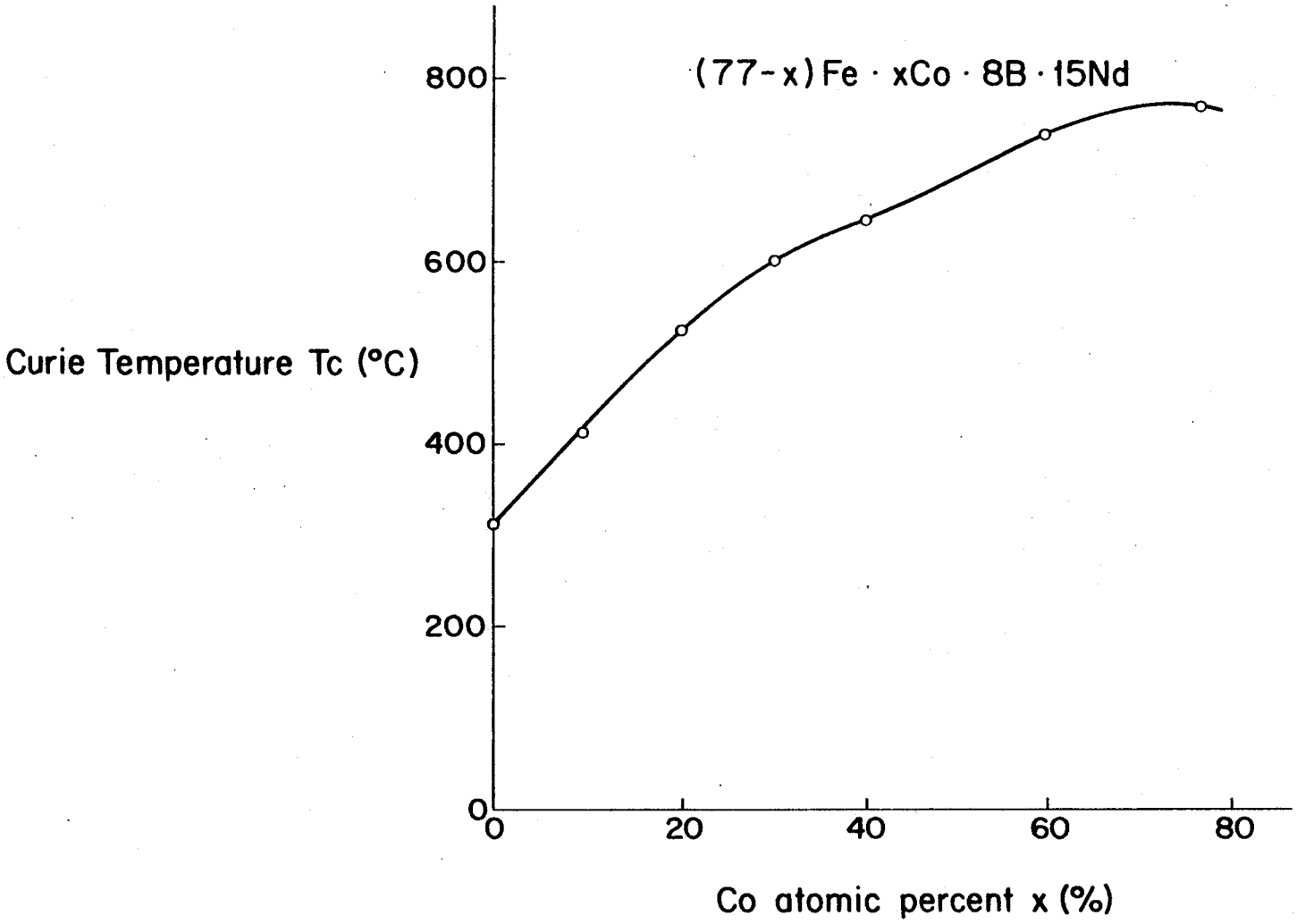

The present invention will now be explained in further detail.

FIRST ASPECT (The description of the first aspect also generally applies to the subsequent aspects if not otherwise specified.)

In the permanent magnet materials of the present invention, the amount of B should be no less than 2% ("%" shall hereinafter stand for the atomic percentage in the alloys) to meet a coercive force iHc of no less than 3 kOe, and should be no more than 28% to attain a residual magnetic flux density Br of no less than about 6 kG which is far superior to hard ferrite. The amount of R should be no less than 8% so as to attain a coercive force of no less than 3 kOe. However, it is required that the amount of R be no higher than 30%, since R is so apt to burn that difficulties are involved in the technical handling and production, and is expensive, too.

The raw materials are inexpensive, and so the present invention is very useful, since resourceful rare earth may be used as R without necessarily using Sm, and without using Sm as the main component.

The rare earth elements R used in the present invention includes Y, and embraces light and heavy rare earth, and at least one thereof may be used. In other words, R embraces Nd, Pr, La, Ce, Tb, Dy, Ho, Er, Eu, Sm, Gd, Pm, Tm, Yb, Lu and Y. It suffices to use certain light rare earth as R, and particular preference is given to Nd and Pr. Usually, it suffices to use one of Nd, Pr, Dy, Tb, Ho or the like as R, but, practically, use is made of mixtures of two or more elements (mischmetal, didymium, etc.) due to easiness in availability, etc. Sm, Y, La, Ce, Gd, etc. may be used in the form of mixtures with other R, especially Nd, Pr, Dy, Tb, Ho, etc. It is noted that R may not be pure rare earth elements, and may contain impurities, other rare earth elements, Ca, Mg, Fe, Ti, C, O, etc. which are to be inevitably entrained from the process of production, as long as they are industrially available. To obtain the most preferable effect upon an increase in coercive force, a combination of $R_1$, one or more selected from the group consisting of Dy, Tb, Gd, Ho, Er, Tm and Yb, with $R_2$ consisting of at least 80% (per total $R_2$) of Nd and Pr and the balance being one or more rare earth elements including Y, except for $R_1$, is used as R. It is preferred to contain no Sm or as little as Sm, and La should not be present much, too, preferably each below 2% (more preferably below 1%).

The boron B used may be pure boron or ferroboron, and may contain as the impurities Al, Si, C, etc. In the magnet materials of the present invention, the balance is constituted by Fe, save B and R, but may contain impurities to be inevitably entrained from the process of production.

Composed of 8–30% R, 2–28% B and the balance being Fe, the permanent magnet materials of the present invention show magnetic properties expressed in terms of a maximum energy product (BH)max exceeding largely 4 MGOe of hard ferrite.

So far as R is concerned, it is preferred that the sum of Nd and Pr is at least 50% (most preferred 80% or more) in the entire R in order to attain high magnetic properties with sureness and less expense.

Preferred is a composition range in which light rare earth (Nd, Pr) accounts for 50% or more of the overall R, and which is composed of 12–24% R, 3–27% B and the balance of Fe, since (BH)max exceeds 10 MGOe. Very preferred is a composition range in which the sum of Nd and Pr accounts for 50% or more of the overall R and which is composed of 12–20% R, 5–24% B and the balance of Fe, since the resulting magnetic properties are then expressed in terms of (BH)max exceeding 15 MGOe and reaching a high of 35 MGOe. If $R_1$ is 0.05–5%, R is 12.5–20%, B is 5–20% and the balance is Fe, then the maximum energy product (BH)max is maintained at no lower than 20 MGOe with iHc of no lower than 10 kOe. However, the aging treatment of the present invention brings about an additional effect. Furthermore, a composition of 0.2-3% $R_1$, 13-19% R, 5-11% B and the balance being Fe gives rise to a maximum energy product (BH)max of no lower than 30 MGOe.

A further preferable FeBR range is given at 12.5-20% R, 5-15% B and 65-82.5% Fe, wherein an energy product of 20 MGOe or more is attainable. Above 20% R or below 65% Fe, Br will decrease. iHc will decrease above 82.5% Fe.

A still further preferable FeBR range is at 13-18% R, 5-15% B, and 67-82% Fe, wherein the energy product can exceed 20 MGOe while at 5-11% B can 30 MGOe.

It is surprising that the energy product of 40 MGOe or higher up to 44 MGOe can be achieved, i.e., approximately at 6-7% B, 13-14.5% R, and the balance of Fe (or with certain amount of Co and/or M). Co may be up to 10% and M may be up to about 1%.

In a little wider range, the energy product can be 35 MGOe or more, i.e., 6-11% B, 13-16% R and the balance of Fe. M may be up to 2% and Co may be up to 15%.

It should be noted that in the subsequent aspects containing Co or M, these amounts should be included in the Fe amounts hereinabove discussed, since Fe is defined as the balance in every composition.

The permanent magnet materials of the present invention are obtained by pulverizing, forming (compacting), sintering, and further heat-treating the alloys having the aforesaid compositions.

The present invention will now be explained with reference to the preferred embodiment of the process for producing magnetically anisotropic FeBR permanent magnet materials.

As the starting materials use may be made of electrolytic iron as Fe, pure boron or ferroboron as B, and rare earth R of 95% or more purity. Within the aforesaid range, these materials are weighed and formulated, and melted into alloys, e.g., by means of high-frequency melting, are melting, etc. in vacuo or in an inert gas atmosphere, followed by cooling. The thus obtained alloys are roughly pulverized by means of a stamp mill, a jaw crusher, etc. and are subsequently finely pulverized by means of a jet mill, a ball mill, etc. Fine pulverization may be carried out in the dry manner to be effected in an inert gas atmosphere, or alternatively in the wet manner to be effected in an organic solvent such as acetone, toluene, etc. The alloy powders obtained by fine pulverization are adjusted to a mean particle size of 0.3-80 microns. In a mean particle size below 0.3 microns, considerable oxidation of the powders takes place during fine pulverization or in the later steps of production, resulting in no density increase and low magnet properties. (A further slight reduction in the particle size might be possible under particular conditions. However, it would be difficult and require considerable expense in the preparation and apparatus.) A mean particle size exceeding 80 microns makes it impossible to obtain higher magnet properties, inter alia, make coercive force high. To obtain excellent magnet properties, the mean particle size of fine powders is preferably 1-40 microns, most preferably 2-20 microns.

The powders having a mean particle size of 0.3-80 microns are pressed and formed in a magnetic field (of e.g., no less than 5 kOe). A forming pressure is preferably 0.5-3.0 ton/cm$^2$. For pressing and forming the powders in a magnetic field, they may be formed per se, or may alternatively be formed in an organic solvent such as acetone, toluene, etc. The formed body is sintered at a temperature of 900°-1200° C. for a given period of time in a reducing or non-oxidizing atmosphere, for example, in vacuum of no higher than $10^{-2}$ Torr or in an inert or reducing gas atmosphere, preferably inert gas of 99.9% or higher (purity) under a pressure of 1-760 Torr. At a sintering temperature below 900° C., no sufficient sintering density is obtained. Nor is high residual magnetic flux density obtained. At a temperature of higher than 1200° C., the sintered body deforms and misalignment of the crystal grains occurs, so that there are drops of the residual magnetic flux density and the loop rectangularity of demagnetization curves. On the other hand, a sintering period may be 5 minutes or longer, but, too long a period poses a problem with respect to mass-productivity. Thus a sintering period of 0.5-4 hours is preferred with respect to the acquisition of magnet properties, etc. in mind. It is noted that it is preferred that the inert or reducing gas atmosphere used as the sintering atmosphere is maintained at a high level, since one component R is very susceptible to oxidation at high temperatures. When using the inert gas atmosphere, sintering may be effected under a reduced pressure of 1 to less than 760 Torr to obtain a high sintering density.

While no particular limitation is placed upon the rate of temperature rise during sintering, it is desired that, in the aforesaid wet forming, a rate of temperature rise of no more than 40° C./min is applied to remove the organic solvents, or a temperature range of 200°-800° C. is maintained for 0.5 hours or longer in the course of heating for the removal of the organic solvents. In cooling after sintering, it is preferred that a cooling rate of no less than 20° C./min is applied to limit variations in the product (quality). To enhance the magnet properties by the subsequent heat treatment or aging treatment, a cooling rate of no less than 100° C./min is preferably applied after sintering. (However, it is noted that the heat treatment may be applied just subsequent to sintering too.)

The heat treatment to be effected after sintering comprises the following stages. First of all, the sintered body is subjected to a first-stage heat treatment at a temperature of 750°-1000° C. and, thereafter, is cooled to a temperature of no higher than 680° C. at a cooling rate of 3°-2000° C./min. Thereafter, the thus cooled body is subjected to a second-stage heat treatment at a temperature of 480°-700° C.

Referring to the first-stage heat treatment temperature, the first-stage heat treatment is so uneffective at a temperature of less than 750° C. that the enhanced amount of the coercive force is low. At a temperature exceeding 1000° C., the sintered body undergoes crystal grain growth, so that the coercive force drops.

To enhance the coercive force of magnet properties and the loop rectangularity of demagnetization curves, and to reduce variations therein, the first-stage heat treatment temperature is preferably 770°-950° C., most preferably 790°-920° C.

Referring to the cooling rate to be applied following the first-stage heat treatment, the coercive force and the loop rectangularity of demagnetization curves drop at a cooling rate of less than 3° C./min, while micro-cracks occur in the sintered body at a cooling rate of higher than 2000° C./min, so that the coercive force drops.

The temperature range in which the given cooling rate should be maintained is limited to ranging from the first-stage heat treatment temperature to a temperature of no higher than 680° C. Within a temperature range of no higher than 680° C., cooling may be effected either gradually or rapidly. If the lower limit of a cooling temperature range at the given cooling rate is higher than 680° C., there is then a marked lowering of coercive force. To reduce variations in magnet properties without lowering them, it is desired that the lower limit of a cooling temperature range at the given rate is no higher than 650° C. In order to enhance the coercive force and the loop rectangularity of demagnetization curves as well as to reduce variations in the magnet properties and supress the occurrence of micro-cracks, the cooling rate is preferably 10°-1500° C./min, most preferably 20°-1000° C./min.

One characteristic feature of the two-stage heat treatment of the present invention is that, after the primary heat treatment has been applied at a temperature of 750°-1000° C., cooling to a temperature of no higher than 680° C. is applied, whereby rapid cooling is applied to the range between 750° C. and 700° C., and, the secondary heat treatment is applied in a low temperature zone of 480°-700° C. The point to be noted in this regard is, however, that, if the secondary heat treatment is effected immediately subsequent to cooling such as cooling in the furnace etc. after the primary heat treatment has been applied, then the improvement in the resulting magnet properties are limited. In other words, it is inferred that there would be between 750° C. and 700° C. an unknown unstable region of a crystal structure or a metal phase, which gives rise to deterioration of the magnet properties; however, the influence thereof is eliminated by rapid cooling. It is understood that the secondary heat treatment may be effected immediately, or after some delay, subsequent to the predetermined cooling following the primary heat treatment.

The temperature for the secondary heat treatment is limited to 480°-700° C. At a temperature of less than 480° C. or higher than 700° C., there are reduced improvements in the coercive force and the loop rectangularity of demagnetization curves. To enhance the coercive force and the loop rectangularity of demagnetization curves as well as to reduce variations in the magnet properties, the temperture range of the secondary heat treatment is preferably 520°-670° C., most preferably 550°-650° C.

While no particular limitation is imposed upon the first-stage heat treatment time, a preferred period of time is 0.5 to 8.0 hours, since temperature control is difficult in too short a time, whereas industrial merits diminish in too long a period.

While no particular limitation is also placed upon the second-stage heat treatment time, a preferred period of time is 0.5 to 12.0 hours, since, like the foregoing, temperature control is difficult in too short a time, whereas industrial merits diminish in too long a time.

Reference is now made to the atmosphere for the aging treatment. Since R, one component of the alloy composition, reacts violently with oxygen or moisture at high temperatures, the vacuum to be used should be no higher than $10^{-3}$ Torr in the degree of vacuum. Or alternatively the inert or reducing gas atmosphere to be used should be of 99.99% or higher purity. The sintering temperature is selected from within the aforesaid range depending upon the composition of the permanent magnet materials, whereas the aging temperature is selected from a range of no higher than the respective sintering temperature.

It is noted that the aging treatment including the 1st and 2nd-stage heat treatments may be carried out subsequent to sintering, or after cooling to room temperature and re-heating have been applied upon completion of sintering. In either case, equivalent magnet properties are obtained.

The present invention is not exclusively limited to the magnetically anisotropic permanent magnets, but is applicable to the magnetically isotropic permanent magnets in a substantially similar manner, provided that no magnetic field is impressed during forming, whereby excellent magnet properties are attained.

Composed of 10-25% R, 3-23% B, and the balance being Fe and inevitable impurities, the isotropic magnets show (BH)max of no less than 3 MGOe. Although the isotropic magnets have originally their magnet properties lower than those of the anisotropic magnets by a factor of ¼-1/6, yet the magnets according to the present invention show so high properties relative to isotropy. As the amount of R increases, iHc increase, but Br decreases after reaching the maximum value. Thus, the amount of R should be no less than 10% and no higher than 25% to meet (BH)max of no less than 3 MGOe.

As the amount of B increases, iHc increases, but Br decreases after reaching the maximum value. Thus, the amount of B should be between 3% and 23% to obtain (BH)max of no less than 3 MGOe.

Preferably, high magnetic properties expressed in terms of (BH)max of no less than 4 MGOe is obtained in a composition in which the main component of R is light rare earth such as Nd and/or Pr (accounting for 50% or higher of the overall R) and which is composed of 12-20% R, 5-18% B and the balance being Fe. Most preferable is a composition in which the main component of R is light rare earth such as Nd, Pr, etc., and which is composed of 12-16% R, 6-18% B and the balance being Fe, since the resulting isotropic permanent magnets show magnet properties represented in terms of (BH)max of no less than 7 MGOe that has not even been achieved in the prior art isotropic magnets.

In the case of anisotropic magnets, any binders and llubricants are not generally used, since they interfer with orientation in forming. In the case of isotropic magnets, however, the incorporation of binders, lubricants, etc. may lead to improvements in pressing efficiency, increases in the strength of the formed bodies, etc.

The permanent magnets of the present invention may also permit the presence of impurities which are to be inevitably entrained form the industrial production. Namely, they may contain within the given ranges Ca, Mg, O, C, P, S, Cu, etc. No more than 4% of Ca, Mg and/or C, no more than 3.5% Cu and/or P, no more than 2.5% S, and no more than 2% of O may be present, provided that the total amount thereof should be no higher than 4%. C may originate from the organic binders used, while Ca, Mg, S, P, Cu, etc. may result from the raw materials, the process of production, etc. The effect of C, P, S and Cu upon the Br is substantially similar with the case without aging since the aging primarily affets the coercivity. In this connection our earlier EP application now published as EPA 101552 is referred to, wherein such impurities may be defined to a certain level depending upon any desired Br level.

As detailed above, the first aspect of the present invention realizes inexpensive, Fe-base permanent magnet materials in which Co is not used at all, and which show high residual magnetization, coercive force and energy product, and is thus of industrially high value.

The FeBR base magnetic materials and magnets hereinabove disclosed has a main (at least 50 vol %: preferably at least 80 vol %) magnetic phase of an FeBR type tetragonal crystal structure and generally of the crystalline nature that is far different from the melt-quenched ribbons or any magnet derived therefrom. The central chemical composition thereof is believed to be $R_2Fe_{14}B$ and the lattice parameters are a of about 8.8 angstrom and c of about 12.2 angstrom. The crystal grain size in the finished magnetic materials usually ranges 1-80 microns (note for FeCoBR, FeBRM or FeCoBRM magnet materials 1-90 microns) preferably 2-40 microns. With respect to the crystal structure EPA 101552 may be referred to for reference.

The FeBR base magnetic materials include a secondary nonmagnetic phase, which is primarily composed of R rich (metal) phase and surrounds the grains of the main magnetic phase. This nonmagnetic phase is effective even at a very small amount, e.g., 1 vol % is sufficient.

The Curie temperature of the FeBR base magnetic materials ranges from 160° C. (for Ce) to 370° C. (for Tb), typically around 300° C. or more (for Pr, Nd etc).

SECOND ASPECT

According to the second aspect of the present invention the FeBR has magnetic material further contain cobalt Co in a certain amount (50 % or less) so that the Curie temperature of the resultant FeCoBR magnet materials will be enhanced. Namely a part of Fe in the FeBR base magnet material is substituted with Co. A post-sintering heat treatment (aging) thereof improves the coercivity and the rectangularity of the demagnetization curves, which fact was disclosed in the Japanese Patent Application No. 58-90802, corresponding European application now EPA 126802.

According to this aspect, a further improvement can be realized through the two-stage heat treatment as set forth hereinabove. For the FeCoBR magnet materials the heat treatment, as well as forming and sintering procedures, are substantially the same as the FeBR base magnet materials.

In general, it is appreciated that some Fe alloys increase in Curie points Tc with increases in the amount of Co to be added, while another decrease, thus giving rise to complicated results which are difficult to anticipate, as shown in FIG. 1. According to this aspect, it has turned out that, as a result of the substitution of a part of Fe of the FeBR systems Tc rises gradually with increases in the amount of Co to be added. A parallel tendency has been confirmed regardless of the type of R in the FeBR base alloys. Co is effective for increasing Tc in a slight amolunt (of, for instance, barely 0.1 to 1%). As exemplified by (77-x)FexCo8B15Nd in FIG. 1, alloys having any Tc between ca. 300° C. and ca. 670° C. may be obtained depending upon the amount of Co.

In the FeCoBR base permanent magnets according to this aspect, the amounts of the respective components B, R and (Fe+Co) are basically the same as in the BeBR base magnets.

The amount of Co should be no more than 50% due to its expensiveness and in view of Tc improvements and Br. In general, the incorporation of Co in an amount of 5 to 25%, in particular 5 to 15% brings about preferred results.

Composed of 8-30% R, 2-28% B, no more than 50% Co and the balance being substantially Fe, the permanent magnet materials according to this aspect show magnetic properties represented in terms of a coercive force of no less than 3 KOe and a residual magnetic flux density Br of no less than 6 KG, and exhibit a maximum energy product (BH)max exceeding by far that of hard ferrite.

Preferred is a compositional range in which the main components of R are light rare earth (Nd, Pr) accounting for 50% or higher of the overall R, and which is composed of 12-24% R, 3-27% B, no more than 50% Co, and the balance being substantially Fe, since the resulting (BH)max reaches or exceeds 10 MGOe. More preferable is a compositional range in which the overall R contain 50% or higher of Nd+Pr, and which is composed of 12-20% R, 5-24% B, no more than 25% Co, and the balance being substantially Fe, since it is possible to obtain magnetic properties represented in terms of (BH)max exceeding 15 MGoe and reaching 35 MGOe or more. When Co is no less than 5%, the temperature coefficient ($\alpha$) of Br is no higher than 0.1%/°C., which means that the temperature dependence is favorable. In an amount of no higher than 25 %, Co contributes to increases in Tc without deteriorating other magnetic properties (equal or more improved properties being obtained in an amount of no higher than 23%). A composition of 0.05-5% $R_1$, 12.5-20% R, 5-20% B, no more than 35% Co and the balance being Fe allows a maximum energy product (BH)max to be maintained at no less than 20 MGOe and iHc to exceed 10 KOe. To such a composition, however, the effect of the aging treatment according to the present invention is further added. Moreover, a composition of 0.2-3% $R_1$, 13-19% R, 5-11% B, no more than 23% Co and the balance being Fe shows a maximum energy product (BH)max exceeding 30 MGOe.

Over the the FeBR systems free from Co, the invented FeCoBR base magnet bodies do not only have better temperature dependence, but are further improved in respect of the rectangularity of demagnetization curves by the addition of Co, whereby the maximum energy product can be improved. In addition, since Co is more corrosion-resistant than Fe, it is possible to afford corrosion resistance to those bodies by the addition of Co.

ISOTROPIC FeCoBR magnets

With 50% or less Co inclusion substituting for Fe, almost the same applies as the FeBR base isotropic magnets, particularly with respect to the R and B amounts. The referred composition for (BH)max of at least 4 MGOe allows 35% or less Co, while the most preferred composition for (BH)max of at least 17 MGOe allows 23% or less Co.

Substantially the same level of the impurities as the FeBR base magnet materials applies to the FeCoBR magnet materials.

THIRD ASPECT

FeBRM magnetic materials

FOURTH ASPECT

FeCoBRM magnetic materials

According to the third or forth aspect of the present invention, the certain additional elements M may be incorporated in the FeBR base magnet materials of the first aspect or the FeCoBR magnet materials of the second aspect, which constitute the third and fourth aspect, respectively. The additional elements M comprises at least one selected from the group consisting of V, Nb, Ta, Mo, W, Cr, Al, Ti, Zr, Hf, Mn, Ni, Ge, Sn, Bi, Sb, Si and Zn in the given amount as set forth in the Summary. The incorporation of M serves, in most cases, to improvements in coercivity and loop squareness particularly for the anisotropic magnet materials.

Substantially the same will apply to the third and fourth aspects with respect to the heat treatment as well as the other preparation, e.g., forming, sintering etc.

With respect to the amount and role of R and B, substantially the same will apply to the third and fourth aspects as the first aspect. With respect to Co, substantially the same as the second aspect will apply to the fourth aspect.

Now, referring to the additional elements M in the permanent magnet materials according to these aspects, they serve to increase the coercive force. Especially, they serve to increase that coercive force in the maximum region of Br, thereby improving the rectangularity of demagnetization curves. The increase in the coercive force leads to an increase in the stability of magnets and enlargement of their use. However, Br drops with increases in the amount of M. For that reason, there is a decrease in the maximum enrgy product (BH)max. The M-containing alloys are very useful esp., in a (BH)max range of no less than 6 MGOe, since there are recently increasing applications where high coercive force is needed at the price of slight reductions in (BH)max.

To ascertain the effect of the additional elements M upon Br, Br was measured in varied amounts of M to measure Br changes. In order to allow Br to exceed by far about 4 kG of hard ferrite and (BH)max to exceed by far about 4 MGOe of hard ferrite, the upper limits of the amounts of M to be added are fixed as follows: 9.5% V, 12.5% Nb, 10.5% Ta, 9.5% Mo, 9.5% W, 8.5% Cr, 9.5% Al, 4.5% Ti, 5.5% Zr, 5.5% Hf, 8.0% Mn, 8.0% Ni, 7.0% Ge, 3.5% Sn, 5.0% Bi, 2.5% Sb, 5.0% Si, 2.0% Zn.

Except for 0% M, one or two or more of M may be used. When two or more of M are contained, the resulting properties are generally represented in terms of the intermediate values lying between the characteristic values of the individual elements added, and the respective amounts thereof should be within the aforesaid % ranges, while the combined amount thereof should be no more than the maximum values given with respect to the respective elements as actually contained.

In the aforesaid FeBRM compositions, the permanent magnet materials of the present invention have a maximum energy product (BH)max far exceeding that of hard ferrite (up to 4 MGOe).

Preferred is a compositional range in which the overall R contains 50% or higher of light rare earth elements (Nd, Pr), and which is composed of 12-24% R, 3-27% B, one or more of the additional elements M—no more than 8.0% V, no more than 10.5% Nb, no more than 9.5% Ta, no more than 7.5% Mo, no more than 7.5% W, no more than 6.5% Cr, no more than 7.5% Al, no more than 4.0% Ti, no more than 4.5% Zr, no more than 4.5% Hf, no more than 6.0% Mn, no more than 3.5% Ni, no more than 5.5% Ge, no more than 2.5% Sn, no more than 4.0% Bi, no more than 1.5% Sb, no more than 4.5% Si and no more than 1.5% Zn—provided that the sum thereof is no more than the maximum given atomic percentage among the additinal elements M as contained, and the balance being substantially Fe, since (BH)max preferably exceeds 10 MGOe. More preferable is a compositional range in which the overall R contains 50% or higher of light rare earth elements (Nd, Pr), and which is composed of 12-20% R, 5-24% B, one or more of the additional elements M—no more than 6.5% V, no more than 8.5% Nb, no more than 8.5% Ta, no more than 5.5% Mo, no more than 5.5% W, no more than 4.5% Cr, no more than 5.5% Al, no more than 3.5% Ti, no more than 3.5% Zr, no more than 3.5% Hf, no more than 4.0% Mn, no more than 2.0% Ni, no more than 4.0% Ge, no more than 1.0% Sn, no more than 3.0% Bi, no more than 0.5% Sb, no more than 4.0% Si and no more than 1.0% Zn—provided that the sum thereof is no more than the maximum given atomic percentage among the additional elements M as contained, and the balance being substantially Fe, since it is possible to achieve (BH)max of no lower than 15 MGOe and a high of 35 MGOe or higher.

A composition of 0.05% $R_1$, 12.5-20% R, 5-20% B, no more than 35% Co, and the balance being Fe allows a maximum energy product (BH)max to be maintained at no less than 20 MGOe and iHc to exceed 10 kOe. To such a composition, however, the effect of the aging treatment according to the present invention is further added. Furthermore, a composition of 0.2-3% $R_1$, 13-19% R, 5-11% B and the balance being Fe shows a maximum energy product (BH)max exceeding 30 MGOe. Particularly useful M is V, Nb, Ta, Mo, W, Cr and Al. The amount of M is preferably no less than 0.1% and no more than 3% (most preferably up to 1%) in view of its effect.

With respect to the effect of the additional elements M the earlier application EPA 101552 may be referred to for reference to understand how the amount of M affects the Br. Thus it can be appreciated to define the M amount depending upon any desired Br level.

ISOTROPIC MAGNETS

Referring to the isotropic magnets, substantially the same as the foregoing aspects will apply except for those mentioned hereinbelow. The amount of the additional elements M should be the same as the anisotropic magnet materials of the third and fourth aspects provided that no more than 10.5% V, no more than 8.8% W, no more than 4.7% Ti, no more than 4.7% Ni, and no more than 6.0% Ge.

In the case of the isotropic magnets generally for the first through fourth aspects, certain amount of impurities are permitted, e.g., C, Ca, Mg (each no more than 4%); P (no more than 3.3%), S (no more than 2.5%), Cu (no more than 3.3%), etc. provided that the sum is no more than the maximum thereof.

In what follows, the inventive embodiments according to the respective aspects and the effect of the present invention will be explained with reference to the examples. It is understood, however, that the present invention is not limited by the examples and the manner of description.

Tables 1 to 20 inclusive show the properties of the FeBR base permanent magnets prepared by the following steps. Namely, Tables 1 to 5, Tables 6 to 10, Tables 11 to 15 and Tables 16 to 20 enumerate the properties of the permanent magnet bodies of the compositions based on FeBR, FeCoBR, FeBRM and FeCoBRM, respectively.

(1) Referring to the starting materials, electrolytic iron of 99.9% purity (given by weight %, the same shall hereinafter apply to the purity of the raw materials) was used as Fe, a ferroboron alloy (19.38% B, 5.32% Al, 0.74% Si, 0.03% C and the balance of Fe) was used as B, and rare earth elements of 99% or more purity (impurities being mainly other rare earth metals) was used as R.

Electrolytic Co of 99.9% purity was used As Co.

The M used was Ta, Ti, Bi, Mn, Sb, Ni, Sn, Zn and Ge, each of 99% purity, W of 98% purity, Al of 99.9% purity and Hf of 95% puirty. Ferrozirconium containing 77.5% Zr, ferrovanadium containing 81.2% V, ferroniobium containing 67.6% Nb and ferrochromium containing 61.9% Cr were used as Zr, V, Nb and Cr, respectively.

(2) The raw magnet materials were melted by means of high-frequency induction. An aluminium crucible was then used as the crucible, and casting was effected in a water-cooled copper mold to obtain ingots.

(3) The ingots obtained by melting were crushed to −35 mesh, and pulverized in a ball mill in such a manner that the given mean particle size was obtained.

(4) The powders were formed under the given pressure in a magnetic field. (In the production of isotropic magnets, however, forming was effected without application of any magnetic field.)

(5) The formed bodies were sintered at the given temperature within a range of 900°-1200° C. in the given atmosphere and, thereafter, were subjected to the given heat treatments.

EXAMPLE 1

An alloy having a composition of 77Fe9B14Nd in atomic percentage was obtained by high-frequency melting in an argon gas and casting with a water-cooled copper mold. The obtained alloy was roughly pulverized to no more than 40 mesh by means of stamp mill, and was then finely pulverized to a mean particle size of 8 microns by means of a ball mill in an argon atmosphere. The obtained powders were pressed and formed at a pressure of 2.2 ton/cm$^2$ in a magnetic field of 10 kOe, and were sintered at 1120° C. for 2 hours in 760 Torr argon of 99.99% purity. After sintering, the sintered body was cooled down to room temperature at a cooling rate of 500° C./min. Subsequently, the aging treatment was effected at 820° C. for various periods in an argon atmosphere, following cooling to no higher than 650° C. at a cooling rate of 250° C./min, and the aging treatment was further carried out at 600° C. for 2 hours to obtain the magnets of the present invention.

The resulting magnet properties are set forth in Table 1 along with those of the comparison example wherein a single-stage heat treatment was applied 820° C.

TABLE 1

| 1st Stage Aging Temp. (°C.) | Aging Time (hr) | Br (kG) | iHc (kOe) | (BH)max (MGOe) |
|---|---|---|---|---|
| Comparative (After 1st Stage Aging) | | 10.6 | 6.2 | 24.1 |
| 820 | 0.75 | 11.2 | 10.8 | 29.2 |
| 820 | 1.0 | 11.2 | 11.9 | 29.4 |
| 820 | 4.0 | 11.2 | 12.4 | 29.6 |
| 820 | 8.0 | 11.2 | 10.9 | 29.1 |

EXAMPLE 2

An alloy having a composition of 70Fel3B9Nd8Pr in atomic percentage was obtained by melting in argon gas arc and casting with a water-cooled copper mold. The obtained alloy was roughly pulverized to no more than 40 mesh by a ball mill, and was finely pulverized to a mean particle size of 3 microns in an organic solvent by means of a ball mill. The thus obtained powders were pressed and formed at a pressure of 1.5 ton/cm$^2$ in a magnetic field of 15 kOe, and were sintered at 1140° C. for 2 hours in 250 Torr argon of 99.999% purity. After sintering, the sintered body was cooled down to room temperature at a cooling rate of 150° C./min. Subsequently, the first-stage aging treatment was effected for 2 hours at various temperatures as specified in Table 2, followed by cooling to no higher than 600° C. at a cooling rate of 300° C./min, and the second-stage aging treatment was further effected at 640° C. for 8 hours to obtain the magnets of the present invention. The resulting magnet properties are set forth in Table 2 along with those of the comparison example (after a single-stage aging treatment).

TABLE 2

| 1st Stage Aging Temp. (°C.) | Aging Time (hr) | Br (kG) | iHc (kOe) | (BH)max (MGOe |
|---|---|---|---|---|
| 800 | 120 | 8.9 | 11.8 | 19.5 |
| 850 | 120 | 8.9 | 11.7 | 19.9 |
| 900 | 120 | 8.9 | 11.8 | 19.5 |
| 950 | 120 | 8.7 | 8.3 | 17.2 |
| 720 | 120 | 8.6 | 6.3 | 15.3 |
| Comparative Comparative (after 1st stage aging) | | 8.4 | 6.2 | 15.4 |

EXAMPLE 3

Fe-B-R alloys of the compositions in atomic percentage, as specified in Table 3, were obtained by melting in Ar gas arc and casting with a water-cooled copper mold. The alloys were roughly pulverized to no more than 50 mesh by means of a stamp mill, and were finely pulverized to a mean particle size of 5 microns in an organic solvent by means of a ball mill. The powders were pressed and formed at a pressure of 2.0 ton/cm$^2$ in a magnetic field of 12 kOe, and were sintered at 1080° C. for 2 hours in 150 Torr Ar of 99.999% purity, followed by rapid cooling to room temperature at a cooling rate of 600° C./min. Subsequently, the first-stage aging treatment was effected at 800° C. for 2 hours in 500 Torr Ar of high purity, followed by cooling to no higher than 630° C. at a cooling rate of 300° C./min, and the second-stage aging treatment was conducted at 620° C. for 4 hr to obtain the invented alloy magnets. The results of the magnet properties are set forth in Table 3 along with those of the comparison examples (after the first-stage aging treatment).

TABLE 3

| Composition | Br (kG) | iHc (kOe) | (BH)max (MGOe) |
|---|---|---|---|
| 78Fe9B13Nd | 11.4 | 14.3 | 27.1 |
| 69Fe15B14Pr2Nd | 8.5 | 12.4 | 15.8 |
| 71Fe14B10Nd5Gd | 8.9 | 10.9 | 17.3 |
| 66Fe19B8Nd7Tb | 8.1 | 12.4 | 15.2 |
| 69Fe14B10Nd5Gd (after 1st stage aging) | 8.5 | 6.9 | 14.2 |
| 66Fe19B8Nd7Tb (after 1st stage aging) | 7.9 | 7.4 | 11.9 |

EXAMPLE 4

Fe-B-R alloys of the following compositions in atomic percentage were obtained by melting in Ar gas arc and casting with a water-cooled copper mold. The alloys were roughly pulverized to no more than 35 mesh by means of a stamp mill, and were finely pulverized to a mean particle size of 4 microns in an organic solvent by means of a ball mill. The obtained powders were pressed and formed at a pressure of 1.5 ton/cm$^2$ in the absence of any magnetic field, and were sintered at 1090° C. for 2 hours in 180 Torr of 99.99% purity, followed by rapid cooling to room temperature at a cooling rate of 400° C./min. Subsequently, the first-stage aging treatment was effected at 840° C. for 3 hours in 650 Torr Ar of high purity, followed by cooling to no higher than 600° C. at a cooling rate of 180° C./min, and the second-stage aging treatment was conducted at 630° C.×2 hr to obtain the magnets of the present invention. The results of the magnet properties are set forth in Table 4 along with those of the samples subjected to the first-stage aging treatment alone (comparison examples).

TABLE 4

| Composition | Br (kG) | iHc (kOe) | (BH)max (MGOe) |
|---|---|---|---|
| 76Fe9Bl5Nd | 5.4 | 12.4 | 6.0 |
| 79Fe7B14Nd | 5.6 | 13.0 | 6.2 |
| 78Fe8B12Nd2Gd | 5.6 | 12.3 | 5.9 |
| 76Fe9B15Nd (after 1st stage aging) | 5.2 | 6.9 | 5.2 |
| 79Fe7B14Nd (after 1st stage aging) | 5.3 | 7.4 | 5.1 |

EXAMPLE 5

Fe-B-R alloys of the following compositions in atomic percentage were obtained by high-frequency melting in an Ar gas and casting with a water-cooled copper mold.

The alloys were roughly pulverized to no more than 35 mesh by means of a stamp mill, and were finely pulverized to a mean particle size of 3 microns in an organic solvent by means of a ball mill. The obtained powders were pressed and formed at a pressure of 1.5 ton/cm$^2$ in a magnetic field of 12 kOe, and were sintered at 1080° C. for 2 hours in 200 Torr Ar of 99.99% purity, followed by rapid cooling to room temperature at a cooling rate of 500° C./min.

Subsequently, the aging treatment was effected at 800° C. for 1 hour in 760 Torr Ar, followed by cooling to room temperature at a cooling rate of 300° C./min, and the aging treatment was further conducted at 620° C. for 3 hours to obtain the magnets of the present invention. The results of the magnet properties are set forth in Table 5 along with those of the comparison example (after sintering).

TABLE 5

| Composition | Br (kG) | iHc (kOe) | (BH)max (MGOe) |
|---|---|---|---|
| 79.5Fe6.5B14Nd | 13.7 | 10.2 | 44.2 |
| 79.5Fe6.5B14Nd (Comparative, as-sintered) | 13.6 | 7.2 | 41.4 |

EXAMPLE 6

An alloy of a composition of 62Pe6B16Na16Co in atomic percentage was obtained by high-frequency melting in an argon gas and casting with a water-cooled copper mold. The alloy was roughly pulverized to no more than 35 mesh by a stamp mill, and was finely pulverized to a mean particle size of 3 microns in an argon atmosphere by means of a ball mill. The obtained powders were pressed and formed at a pressure of 2.0 ton/cm$^2$ in a magnetic field of 15 kOe, were sintered at 1100° C. for 2 hours in 760 Torr argon of 99.99% purity, and were thereafter cooled down to room temperature at a cooling rate of 500° C./min. Further, the aging treatment was carried out at 800° C. for various time in an argon atmosphere. After cooling to 500° C. had been carried out at a cooling rate of 400° C./min., the aging treatment was further conducted at 580° C. for 2 hours to obtain the magnets according to the present invention. The results of the magnet properties of the obtained magnets are set forth in Table 6 along with those of the comparison example wherein one-stage aging was applied at 800° C. for 1 hour. Table 6 also shows the temperature coefficient $\alpha$ (%/°C.) of the residual magnetic flux density (Br) of the invented alloy magnets together with that of the comparison example wherein only one-stage aging was applied.

TABLE 6

| Aging Temp. (°C.) | Aging Time (hr) | Br (kG) | iHc (kOe) | (BH)max (MGOe) | $\alpha$ |
|---|---|---|---|---|---|
| Comparative (after 1st stage aging) | | 11.0 | 6.9 | 19.6 | 0.085 |
| 800 | 0.75 | 11.3 | 9.3 | 26.4 | 0.085 |
| 800 | 1.0 | 11.4 | 13.8 | 32.9 | 0.084 |
| 800 | 4.0 | 11.4 | 13.6 | 32.4 | 0.084 |
| 800 | 8.0 | 10.3 | 13.4 | 32.0 | 0.085 |

EXAMPLE 7

An alloy of a compostion of 60Pe12B15Nd3Y10Co in atomic percentage was obtained by melting an argon gas are and casting with a water-cooled copper mold. The obtained alloy was roughly pulverized to no more than 50 mesh by a stamp mill, and was finely pulverized to a mean particle size of 2 microns in an organic solvent by means of a ball mill. The obtained powders were pressed and formed at a pressure of 2.0 ton/cm$^2$ in a magnetic field of 10 kOe, were sintered at 1150° C. for 2 hours in 200 Torr argon of 99.99% purity, and were thereafter cooled to room temperature at a cooling rate of 150° C./min. The first-stage aging was at the respective temperatures as specified in Table 7 in $2\times10^{-5}$ Torr vacuum, followed by cooling to 350° C. at a cooling rate of 350° C./min. Subsequently, the second-stage aging was applied at 620° C. for 4 hours to obtain the magnets according to the present invention. The results of the magnet properties and the temperature coefficient $\alpha$ (%/°C.) of the residual magnetic flux density (Br)

of the magnets according to the present invention are set forth in Table 7 along with those of the comparison example (after the application of one stage aging).

TABLE 7

| Aging Temp. (°C.) | Aging Time (hr) | Br (kG) | iHc (kOe) | (BH)max (MGOe) | α |
|---|---|---|---|---|---|
| 700 | 120 | 10.6 | 8.1 | 17.3 | 0.084 |
| 800 | 120 | 11.8 | 10.9 | 28.1 | 0.082 |
| 850 | 120 | 11.9 | 12.4 | 33.4 | 0.083 |
| 900 | 120 | 11.9 | 13.0 | 33.6 | 0.083 |
| 950 | 120 | 11.9 | 13.2 | 33.9 | 0.083 |
| Comparative (after 1st stage aging) | | 10.6 | 6.4 | 20.4 | 0.083 |

EXAMPLE 8

FeBRCo alloys of the compositions in atomic percentage, as specified in Table 8, were obtained by melting in argon gas arc, and casting with a water-cooled copper mold. The obtained alloys were roughly pulverized to no more than 40 mesh by a stamp mill, and were finely pulverized to a mean particle size of 4 microns in an organic solvent by means of a ball mill. The obtained powders were pressed and formed at a pressure of 1.5 ton/cm$^2$ in a magnetic field of 15 koe, were sintered at 1080° C. for 2 hours in 200 Torr argon of 99.99% purity, and were thereafter rapidly cooled down to room temperature at a cooling rate of 400° C./min. The first-stage aging was then effected at 850° C. for 2 hours in 600 Torr argon, followed by cooling to 350° C. at a cooling rate of 200° C./min. Subsequently, the second-stage heat treatment was carried out at 650° C. for 2 hours to obtain the magnets according to the present invention. The resulting magnet properties and the temperature coefficient α (%/°C.) of Br are set forth in Table 8 together with those of the comparison example subjected to one-stage aging alone.

TABLE 8

| Composition | Br (kG) | iHc (kOe) | (BH)max (MGOe) | α (%/°C.) |
|---|---|---|---|---|
| 59Fe10B17Nd14Co | 12.3 | 9.4 | 34.0 | 0.08 |
| 58Fe8B14Pr20Co | 12.2 | 12.4 | 32.5 | 0.07 |
| 62Fe8B13Nd2Tb15Co | 11.8 | 10.9 | 24.8 | 0.08 |
| 46Fe6B14Nd2La32Co | 12.2 | 13.5 | 27.6 | 0.06 |
| 60Fe6B12Nd2Ho20Co | 11.2 | 8.4 | 22.8 | 0.07 |
| 60Fe6B12Nd2Ho20Co (Comparative; after 1st stage aging) | 11.0 | 6.3 | 20.3 | 0.07 |

EXAMPLE 9

FeBRCo alloys of the following compositions in atomic percentage were obtained by melting argon gas are and casting with a water-cooled copper mold. The alloys were roughly pulverized to no more than 25 mesh by a stamp mill, and were finely pulverized to a mean particle size of 3 mirons in an organic solvent by means of a ball mill. The thus obtained powders were pressed and formed at a pressure of 1.5 ton/cm$^2$ in the absence of any magnetic field, and were sintered at 1030° C. for 2 hours in 250 Torr argon of 99.99% purity. After sintering, rapid cooling to room temperature was applied at a cooling rate of 300° C./min. The primary aging treatment was then carried out at 840° C. for 4 hours in 650 Torr argon, followed by cooling to 450° C. at a cooling rate of 350° C./min. Subsequently, the secondary aging treatment was conducted at 650° C. for 2 hours to obtain the magnets according to the present invention. The results of the magnet properties are set forth in Table 9 along with those of the sample (comparison example) wherein only the primary aging treatment was applied.

TABLE 9

| Composition | Br (kG) | iHc (kOe) | (BH)max (MGOe) |
|---|---|---|---|
| 65Fe9B16Nd10Co | 5.2 | 13.4 | 5.8 |
| 61Fe10B17Nd12Co | 5.4 | 13.6 | 6.0 |
| 62Fe8B13Nd2Gd15Co | 5.6 | 12.7 | 5.7 |
| 65Fe9B16Nd10Co (after 1st stage aging) | 5.2 | 8.6 | 5.1 |
| 61Fe10B17Nd12Co (after 1st stage aging) | 5.3 | 8.3 | 5.0 |

EXAMPLE 10

FeCoBR alloys of the following compositions in atomic percentage were obtained by melting in argon gas arc and casting with a water-cooled copper mold.

The obtained alloys were roughly pulverized to no more than 35 mesh by a stamp mill, and were finely pulverized to a mean particle size of 3 microns in an organic solvent by means of a ball mill. The obtained powders were pressed and formed at a pressure of 1.5 ton/cm$^2$ in a magnetic field of 12 kOe, and were sintered at 1080° C. for 2 hours in 200 Torr argon of 99.99% purity, followed by rapid cooling to room temperature at a cooling rate of 500° C./min.

The aging treatment was effected at 800° C. for 1 hour 760 Torr Ar, followed by cooling to room temperature at a cooling rate of 300° C./min. Subsequently, the aging treatment was conducted at 580° C. for 3 hours to obtain the magnets of the present invention. The results of the magnet properties are set forth in Table 10 along with those of the comparison example (after sintering).

TABLE 10

| Composition | Br (kG) | iHc (kOe) | (BH)max (MGOe) |
|---|---|---|---|
| 73.5Fe6.5B14Nd6Co | 13.6 | 9.7 | 41.8 |
| 73.5Fe6.5B14Nd6Co (Comparative, as-sintered) | 13.4 | 6.8 | 39.1 |

EXAMPLE 11

Alloy powders having a mean particle size of 1.8 microns and a composition BalFe-8B-16Nd-2Ta-1Sb in atomic percentage were pressed and formed at a pressure of 1.5 Ton/cm$^2$ in a magnetic field of 15 kOe, and were sitered at 1080° C. for 2 hours in 250 Torr argon of 99.99% purity, followed by cooling to room temperature at a cooling rate of 600° C./min. The aging treatment was conducted at 780° C. for various time in an argon atmosphere, followed by cooling to 480° C. at a cooling rate of 360° C./min. Subsequently, the aging treatment was conducted at 560° C. for 2 hours to obtain the magnets according to the present invention. The results of the magnet properties are set forth in Table 11 along with those of the comparison example wherein only the one-stage aging treatment was conducted at 780° C. for 1 hour.

TABLE 11

| Aging Temp. (°C.) | Aging Time (hr) | Br (kG) | iHc (kOe) | (BH)max (MGOe) |
|---|---|---|---|---|
| Comparative (after 1st stage aging) | | 12.4 | 10.3 | 33.1 |

TABLE 11-continued

| Aging Temp. (°C.) | Aging Time (hr) | Br (kG) | iHc (kOe) | (BH)max (MGOe) |
|---|---|---|---|---|
| 780 | 0.75 | 12.6 | 12.4 | 35.8 |
| 780 | 1.0 | 12.6 | 12.6 | 36.2 |
| 780 | 4.0 | 12.6 | 12.8 | 36.3 |
| 780 | 8.0 | 12.7 | 12.9 | 36.1 |

EXAMPLE 12

The alloy powders of the following composition BalFe-10B-13Nd-3Pr-2W-1Mn alloys in atomic percentage and a mean particle size of 2.8 microns were pressed and formed at a pressure of 1.5 Ton/cm$^2$ in a magnetic field of 10 kOe, and were sintered at 1120° C. for 2 hours in 280 Torr Ar of 99.999% purity, followed by cooling down to room temperature at a cooling rate of 500° C./min. Subsequent to the first-stage aging treatment at the various temperatures as specified in Table 12 for 2 hour in $4\times10^{-6}$ Torr vacuum, cooling to no more than 600° C. was applied at a cooling rate of 320° C./min., and the second-stage aging treatment was then effected at 620° C. for 8 hours to obtain the permanent magnets according to the present invention. The results of the magnet properties are set forth in Table 12 along with those of the comparison example (after the first-stage aging treatment).

TABLE 12

| Aging Temp. (°C.) | Aging Time (hr) | Br (kG) | iHc (kOe) | (BH)max (MGOe) |
|---|---|---|---|---|
| 800 | 120 | 10.6 | 10.3 | 23.7 |
| 850 | 120 | 10.7 | 11.4 | 23.9 |
| 900 | 120 | 10.7 | 11.0 | 23.5 |
| 950 | 120 | 10.8 | 10.8 | 23.3 |
| 720 | 120 | 10.4 | 8.6 | 21.3 |
| Comparative | | | | |
| Comparative (after 1st stage aging) | | 10.1 | 8.8 | 21.2 |

EXAMPLE 13

The powders of Fe-B-R-M alloys having the compositions in atomic percentage as specified in Table 13 and a mean particle size of 1 to 6 microns were pressed and formed at a pressure of 1.2 Ton/cm$^2$ in a magnetic field of 15 kOe, and were sintered at 1080° C. for 2 hours in 180 Torr Ar of 99.999% purity, followed by rapid cooling to room temperature at a cooling rate of 650° C./min. Further, the aging treatment was carried out at 775° C. for 2 hours in 550 Torr Ar of high purity, followed by cooling to no higher than 550° C. at a cooling rate of 280° C./min. Thereafter, the second-stage aging treatment was conducted at 640° C. for 3 hours to obtain the permanent magnets of the present invention. The results of the magnet properties are set forth in Table 13 along with those of the comparison example (after the single-stage aging treatment).

TABLE 13

| Composition | Br (kG) | iHc (kOe) | (BH)max (MGOe) |
|---|---|---|---|
| Fe8B14Nd1Mo1Si | 12.5 | 10.3 | 34.6 |
| Fe10B14Nd4Pr1Nb1Hf | 11.8 | 12.4 | 32.0 |
| Fe12B10Nd5Gd2V | 10.5 | 11.0 | 24.1 |
| Fe8B8Nd8Ho1Nb1Ge | 9.9 | 13.2 | 22.4 |
| Fe11B15Nd1Mo2Al | 7.9 | 12.8 | 13.6 |
| Fe9B15Nd2Cr1Ti | 11.6 | 11.6 | 33.4 |
| Fe9B15Nd2Cr1Ti (Comparative) | 11.4 | 8.1 | 30.8 |

TABLE 13-continued

| Composition | Br (kG) | iHc (kOe) | (BH)max (MGOe) |
|---|---|---|---|
| Fe16B10Nd5Gd2V (Comparative) | 10.3 | 7.6 | 22.4 |
| Fe14B15Nd1Mo2Al (Comparative) | 7.8 | 6.4 | 12.4 |

EXAMPLE 14

The powders of Fe-B-R-M alloys of the following compositions in atomic percentage and a mean particle size of 2 to 8 microns were pressed and formed at a pressure of 1.0 Ton/cm$^2$ in the absence of any magnetic field, and were sintered at 1080° C. for 2 hours in 180 Torr Ar of 99.999% purity, followed by rapid cooling to room temperature at a cooling rate of 630° C./min. Further, the first-stage aging treatment was effected at 630° C. for 4 hours in 350 Torr Ar, followed by cooling to no higher than 550° C. at a cooling rate of 220° C./min, and the second-stage heat treatment was subsequently conducted at 580° C. for 2 hours to obtain the permanent magnets of the present invention. The results of the magnet properties are set forth in Table 14 along with those of the sample (comparison example) wherein only the first-stage aging treatment was applied).

TABLE 14

| Composition | Br (kG) | iHc (kOe) | (BH)max (MGOe) |
|---|---|---|---|
| Fe8B14Nd1Ta1Zn | 6.3 | 13.0 | 6.4 |
| Fe8B16Nd2Ho2W | 6.4 | 12.7 | 6.6 |
| Fe8B12Nd2Ce1Nb1Mo | 6.6 | 11.4 | 6.9 |
| Fe8B14Nd1Ta1Zn (Comparative) | 6.2 | 10.6 | 6.0 |
| Fe8B16Nd2Ho2W (Comparative) | 6.3 | 10.1 | 5.8 |
| Fe6B18Nd1Cr1Zr | 5.8 | 12.0 | 6.1 |
| Fe6B18Nd1Cr1Zr (Comparative) | 5.7 | 8.9 | 5.4 |

EXAMPLE 15

The Fe-B-R-M alloys of the following compositions in atomic percentage were obtained by high-frequency melting in an Ar gas and casting with a water-cooled copper mold.

The obtained alloys were roughly pulverized to no more than 35 mesh by a stamp mill, and were finely done to a mean particle size of 2.7 microns in an organic solvent by means of a ball mill. The thus obtained powders were pressed and formed at a pressure of 1.5 Ton/cm$^2$ in a magnetic field of 12 kOe, and were sintered at 1080° C. for 2 hours in 200 Torr Ar of 99.99% purity, followed by rapid cooling to room temperature at a cooling rate of 500° C./min.

Subsequently, the aging treatment was effected at 800° C. for 1 hour in 760 Torr Ar, followed by cooling to room temperature at a cooling rate of 300° C./min, and the aging treatment was done at 620° C. for further 3 hours to obtain the magnets of the present invention. The results of the magnet properties are set forth in Table 15 along with those of the comparison example (after sintering).

TABLE 15

| Composition | Br (kG) | iHc (kOe) | (BH)max (MGOe) |
|---|---|---|---|
| Fe7B14Nd1Mo | 13.3 | 11.6 | 42.2 |

TABLE 15-continued

| Composition | Br (kG) | iHc (kOe) | (BH)max (MGOe) |
|---|---|---|---|
| Fe6.5B14Nd1Nb | 13.4 | 11.3 | 42.5 |
| Fe7B14Nd1Mo (Comparative, as-sintered) | 13.2 | 8.8 | 41.1 |
| Fe6.5B14Nd1Nb (Comparative, as-sintered) | 13.3 | 8.2 | 41.8 |

EXAMPLE 16

The powders of an alloy of the composition BalFe-12Co-9B-14Nd-1Mo in atomic percentage and a mean particle size of 35 microns were pressed and formed at a pressure of 1.3 Ton/cm$^2$ in a magnetic field of 12 kOe, and were sintered at 1120° C. for 2 hours in 200 Torr Ar of 99.99% purity, followed by cooling to room temperature at a cooling rate of 650° C./min. Subsequently, the aging treatment was effected at 820° C. at various temperatures in an argon atmosphere, followed by cooling to 480° C. at a cooling rate of 350° C./min., and the aging treatment was conducted at 600° C. for 2 hours to obtain the magnets according to the present invention. The results of the magnet properties and the temperature coefficient $\alpha$ (%/°C.) of the residual magnetic flux density (Br) of the invented alloy magnets are set forth in Table 16 along with those of the magnets subjected to only the single-stage aging treatment of 820° C.×1 hour.

TABLE 16

| Aging Temp. (°C.) | Aging Time (hr) | Br (kG) | iHc (kOe) | (BH)max (MGOe) | $\alpha$ (%/°C.) |
|---|---|---|---|---|---|
| Comparative | | 12.0 | 10.3 | 28.0 | 0.086 |
| 820 | 0.75 | 12.2 | 12.4 | 31.2 | 0.086 |
| 820 | 1.0 | 12.3 | 12.9 | 32.4 | 0.087 |
| 820 | 4.0 | 12.3 | 13.0 | 32.8 | 0.086 |
| 820 | 8.0 | 12.2 | 13.2 | 32.9 | 0.086 |

EXAMPLE 17

The powders of an alloy of the composition BalFe-18Co-10B-14Nd-1Y-2Nd-1Ge in atomic percentage and a mean particle size of 2.8 microns were pressed and formed at a pressure of 1.2 Ton/cm$^2$ in a magnetic field of 12 kOe, and were sintered at 1140° C. for 2 hours in 500 Torr Ar of 99.999% purity, followed by cooling to room temperature at a cooling rate of 400° C./min. Subsequently, the first-stage aging treatment was effected at the various temperatures as specified in Table 17 for 2 hours in $5\times10^{-5}$ Torr vacuum, followed by cooling to 420° C. at a cooling rate of 400° C./min, and the second-stage aging treatment was done at 580° C. for 3 hours to obtain the magnets of the present invention. The results of the magnet properties and the temperature coefficient $\alpha$ (%/°C.) of the residual magnetic flux density (Br) are shown in Table 17 along with those of the comparison example (after the first-stage aging treatment).

TABLE 17

| Aging Temp. (°C.) | Aging Time (min) | Br (kG) | iHc (kOe) | (BH)max (MGOe) | $\alpha$ (%/°C.) |
|---|---|---|---|---|---|
| 700 | 120 | 11.2 | 11.4 | 28.7 | 0.081 |
| 800 | 120 | 11.7 | 11.8 | 28.9 | 0.082 |
| 850 | 120 | 11.6 | 11.7 | 29.3 | 0.081 |
| 900 | 120 | 11.6 | 11.7 | 29.4 | 0.081 |
| 950 | 120 | 11.5 | 11.6 | 29.2 | 0.081 |
| Comparative | | 11.3 | 9.3 | 24.5 | 0.081 |

TABLE 17-continued

| Aging Temp. (°C.) | Aging Time (min) | Br (kG) | iHc (kOe) | (BH)max (MGOe) | $\alpha$ (%/°C.) |
|---|---|---|---|---|---|
| (after 1st stage aging) | | | | | |

EXAMPLE 18

The powders of alloys of the Fe-Co-B-R-M compositions in atomic percentage as specified In Table 18 and a mean particle size of 2 to 8 microns were pressed and formed at a pressure of 1.2 Ton/cm$^2$ in a magnetic field of 12 kOe, and were sintered at 1100° C. for 2 hours in 200 Torr Ar of 99.999% purity, followed by rapid cooling to room temperature at a cooling rate of 750° C./min. The primary aging treatment was conducted at 820° C. for 2 hours in 450 Torr Ar, followed by cooling to 380° C. at a cooling rate of 250° C./min, and the secondary aging treatment was then effected at 600° C. for 2 hours to obtain the magnets of the present invention. The figures of the magnets properties and the temperature coefficient $\alpha$(%/°C.) of Br are set forth in Table 18 along with those of the comparison example wherein the first aging treatment alone was applied.

TABLE 18

| Composition | Br (kG) | iHc (kOe) | (BH)max (MGOe) | $\alpha$ (%/°C.) |
|---|---|---|---|---|
| Fe5Co10B16Nd1Ta1Mn | 12.6 | 10.4 | 35.4 | 0.06 |
| Fe20Co7B9Nd5Pr2W | 11.3 | 9.8 | 27.5 | 0.03 |
| Fe8Co7B12Nd4Tb1V | 12.4 | 11.2 | 31.7 | 0.06 |
| Fe10Co7B16Nd1Al1Bi | 12.8 | 13.8 | 33.4 | 0.05 |
| Fe5Co8B12Nd2Ho1Al | 10.9 | 10.6 | 26.4 | 0.08 |
| Fe5Co8B12Nd2Ho1Al (Comparative) | 10.8 | 7.3 | 23.6 | 0.09 |
| Fe8Co6B20Nd1Cr | 11.2 | 11.4 | 28.8 | 0.08 |
| Fe8Co6B20Nd1Cr (Comparative) | 11.1 | 9.3 | 26.2 | 0.09 |

EXAMPLE 19

The powders of Fe-CoB-R-M alloys of the following compositions and a mean particle size of 1 to 6 microns were pressed and formed at a pressure of 1.2 Ton/cm$^2$ in the absence of any magnetic field, and were sintered at 1080° C. for 2 hours in 180 Torr Ar of 99.999% purity, followed by rapid cooling at room temperature at a cooling rate of 630° C./min. The primary aging treatment was conducted at 850° C. for 4 hours in 700 Torr Ar, followed by cooling to 420° C. at a cooling rate of 380° C./min., and the secondary aging treatment was then effected at 620° C. for 3 hours to obtain the magnets of the present invention. The results of the magnet properties are set forth in Table 19 along with those of the sample (comparison example) not subjected to the secondary aging treatment.

TABLE 19

| Composition | Br (kG) | iHc (kOe) | (BH)max (MGOe) |
|---|---|---|---|
| Fe15Co10B16Nd1Ta | 6.3 | 11.2 | 8.6 |
| Fe10Co8B13Nd2Ho2Al1Sb | 5.9 | 10.4 | 8.3 |
| Fe25Co8B12Nd4Gd2V | 5.3 | 11.7 | 8.2 |
| Fe15Co10B16Nd1Ta (Comparative) | 5.4 | 9.3 | 8.3 |
| Fe10Co10B20Nd1Cr1Zr | 4.9 | 13.4 | 5.2 |
| Fe10Co10B20Nd1Cr1Zr (Comparative) | 4.6 | 10.1 | 4.8 |

EXAMPLE 20

Fe-Co-B-R-M alloys of the following compositions in atomic percentage were obtained by high-frequency melting in an Ar gas and casting with a water-cooled copper mold.

The alloys were roughly pulverized to no more than 35 mesh by means of a stamp mill, and were finely pulverized to a mean particle size of 2.6 microns in an organic solvent by means of a ball mill. The obtained powders were pressed and formed at a pressure of 1.5 ton/cm$^2$ in a magnetic field of 12 koe, and were sintered at 1000° C. for 2 hours in 200 Torr Ar of 99.999% purity, followed by rapid cooling to room temperature at a cooling rate of 500° C./min.

The aging treatment was effected at 800° C. for one hour in 760 Torr Ar, followed by cooling down to room temperature at a cooling rate of 300° C./min., and the aging treatment was conducted at 580° C. for further three hours to obtain the magnets of the present invention. The results of the magnet properties are set forth in Table 20 along with those of the comparison example (after sintering).

TABLE 20

| Composition | Br (kG) | iHc (kOe) | (BH)max (MGOe) |
|---|---|---|---|
| Fe6Co6.5B14Nd1Nb | 13.6 | 11.7 | 41.5 |
| Fe6Co6.5B14Nd1Nb (Comparative, as-sintered) | 13.5 | 7.8 | 40.0 |

What is claimed is:

1. A sintered magnetically anisotropic body having an energy product of at least 30 MGOe and a coercive force of more than 13 kOe that is the product of a process which comprises the steps of:

providing an anisotropic sintered body composed of, in atomic percentage, 13–18% R (provided that R is at least one rare earth element including Y and at least 50% of the entire R is Nd and/or Pr), 5–11% B, and the balance being at least 71% Fe, subjecting the sintered body to a primary heat treatment at a temperature of 750°–1000° C. and below the sintering temperature at which the density of the body has been increased by sintering, then cooling the resultant body to a temperature of no higher than 680° C. at a cooling rate of 3°–2000° C./min, and further subjecting the thus cooled body to a secondary heat treatment of 480°–700° C. wherein the body has a coercive force greater than the anisotropic sintered body with the same composition which is in an as-sintered state or which has been subjected to a one-stage aging treatment.

2. A sintered magnetically anisotropic body having an energy product of at least 30 MGOe and a coercive force of more than 13 kOe that is the product of a process which comprises the steps of:

providing an anisotropic sintered body composed of, in atomic percentage, 13–18% R (provided that R is at least one rare earth element including Y and at least 50% of the entire R is Nd and/or Pr), 5–11% B, no more than 23% Co (except for 0% Co), and the balance being at least 48% Fe, subjecting the sintered body to a primary heat treatment at a temperature of 750°–1000° C. and below the sintering temperature at which the density of the body has been increased by sintering, then cooling the resultant body to a temperature of no higher than 680° C. at a cooling rate of 3°–2000° C./min, and further subjecting the thus cooled body to a secondary heat treatment at a temperature of 480°–700° C. wherein the body has a coercive force greater than the anisotropic sintered body with the same composition which is in an as-sintered state or which has been subjected to a one-stage aging treatment.

3. A sintered magnetically anisotropic body having an energy product of at least 30 MGOe and a coercive force of more than 13 kOe that is the product of a process which comprises the steps of:

providing an anisotropic sintered body composed of, in atomic percentage, 13–18% R (provided that R is at least one rare earth element including Y and at least 50% of the entire R is Nd and/or Pr), 5–11% B, no more than 3% of at least one of the additional elements M (except for 0% M) wherein M is V, Nb, Ta, Mo, W, Cr, Al, Ti, Zr, Hf, Mn, Ni, Ge, Sn, Bi, Sb, Si, and Zn, provided that Sn is no more than 2.5%, and Sb and Zn are no more than 1.5%, respectively, and the balance being at least 68% Fe, subjecting the sintered body to a primary heat treatment at a temperature of 750°–1000° C. and below the sintering temperature at which the density of the body has been increased by sintering, then cooling the resultant body to a temperature of no higher than 680° C. at a cooling rate of 3°–2000° C./min, and further subjecting the thus cooled body to a secondary heat treatment at a temperature of 480°–700° C. wherein the body has a coercive force greater than the anisotropic sintered body with the same composition which is in an as-sintered state or which has been subjected to a one-stage aging treatment.

4. A sintered magnetically anisotropic body having an energy product of at least 30 MGOe and a coercive force of more than 13 kOe that is the product of a process which comprises the steps of:

providing an anisotropic sintered body composed of, in atomic percentage, 13–18% R (provided that R is at least one rare earth element including Y and at least 50% of the entire R is Nd and/or R), 5–11% B, no more than 23% Co (except for 0% Co), no more than 3% of at least one of the additional elements M (except for 0% M) wherein M is V, Nb, Ta, Mo, W, Cr, Al, Ti, Zr, Hf, Mn, Ni, Ge, Sn, Bi, Sb, Si and Zn, provided that Sn is no more than 2.5%, and Sb and Zn are no more than 1.5%, respectively, and the balance being at least 45% Fe, subjecting the sintered body to a primary heat treatment at a temperature of 750°–1000° C. and below the sintering temperature at which the density of the body has been increased by sintering, then cooling the resultant body to a temperature of no higher than 680° C. at a cooling rate of 3°–2000° C./min, and further subjecting the thus cooled body to a secondary heat treatment at a temperature of 480°–700° C. wherein the body has a coercive force greater than the anisotropic sintered body with the same composition which is in an as-sintered state or which has been subjected to a one-stage aging treatment.

5. The product of the process as defined in any one of claims 2–4, wherein Fe or the sum of Fe, Co and M is 71–82%.

6. The product of the process as defined in claim 5, wherein Co is 5-15%.

7. The product of the process as defined in claims 3 or 4, wherein M is at least one selected from the group consisting of V, Nb, Ta, Mo, W, Cr and Al.

8. The product of the process as defined in claim 5, wherein $R=R_1+R_2$ provided that $R_1$ is 0.2-3% of the total material and is at least one of Dy, Tb and Ho, and the balance of R being $R_2$ consisting of at least 80% of R and being at least one of Nd, Pr and rare earth elements including Y other than $R_1$, Nd and Pr.

9. An anisotropic sintered permanent magnet having an energy product of at least 35 MGOe and a coercive force of more than 12 kOe, and consisting essentially of in atomic percentage, 13-16% (provided that R is at least one rare earth element including Y), 6-11% B, and the balance being at least 73% Fe, wherein at least 80% of the entire R is Nd and/or Pr and wherein the magnet has a coercive force greater than a magent with the same composition which is in an as-sintered state or which has been subjected to a one-stage aging treatment.

10. An anisotropic sintered permanent magnet having an energy product of at least 35 MGOe and a coercive force of more than 12 kOe, and consisting essentially of, in atomic percentage, 13-16% R (provided that R is at least one rare earth element including Y), 6-11% B, no more than 15% Co (except for 0% Co), and the balance being at least 58% Fe wherein at least 80% of the entire R is Nd and/or Pr and wherein the magnet has a coercive force greater than a magnet with the same composition which is in an as-sintered state or which has been subjected to a one-stage aging treatment.

11. An anisotropic sintered permanent magnet having an energy product of at least 35 MGOe and a coercive force of more than 12 kOe, and consisting essentially of, in atomic percentage, 13-16% R (provided that R is at least one rare earth element including Y and at least 80% of the entire R is Nd and/or Pr), 6-11% B, no more than 3% of at least one of the additional elements M (except for 0% M) wherein M is V, Nb, Ta, Mo, W, Cr, Al, Ti, Zr, Hf, Mn, Ni, Ge, Sn, Bi, Sb, Si and Zn provided that Sn is no more than 2.5%, and Sb and Zn are no more than 1.5%, respectively, and the balance being at least 70% Fe wherein the magnet has coercive force greater than a magnet with the same composition which is in an as-sintered state or which has been subjected to a one-stage aging treatment.

12. An anisotropic sintered permanent magnet having an energy product of at least 35 MGOe and a coercive force of more than 12 kOe, and consisting essentially of, in atomic percentage, 13-16% R (provided that R is at least one rare earth element including Y and at least 80% of the entire R is Nd and/or Pr), 6-11% B, no more than 15% Co (except for 0% Co), no more than 3% of at least one of the additional elements M (except for 0% M) wherein M is V, Nb, Ta, Mo, W, Cr, Al, Ti, Zr, Hf, Mn, Ni, Ge, Sn, Bi, Sb, Si and Zn provided that Sn is no more than 2.5%, and Sb and Zn are no more than 1.5%, respectively, and the balance being at least 55% Fe wherein the magnet has a coercive force greater than a magnet with the same composition which is in an as-sintered state or which has been subjected to a one-stage aging treatment.

13. A permanent magnet as defined in claim 9, wherein R is 13-14.5%, B is 6-7% and the energy product is at least 40 MGOe.

14. A permanent magnet as defined in claim 10, wherein R is 13-14.5%, B is 6-7%, Co is 0.1-10%, and the energy product is at least 40 MGOe.

15. A permanent magnet as defined in claim 11, wherein R is 13-14.5%, B is 6-7%, M is 0.1-1%, and the energy product is at least 40 MGOe.

16. A permanent magnet as defined in claim 12, wherein R is 13-14.5%, B is 6-7%, Co is 0.1-10%, M is 0.1-1% and the energy product is at least 40 MGOe.

17. A permanent magnet as defined in any one of claims 9-16, wherein R is at least one of Nd and Pr.

18. A permanent magnet as defined in any one of claims 9-16, wherein R is 0.2-3% of the total magnet and comprises at least one of Dy, Tb and Ho, with the balance of R being at least one of Nd and Pr.

19. A permanent magnet as defined in claim 18, wherein the balance of R is Nd.

20. An anisotropic sintered permanent magnet having an energy product of at least 35 MGOe and coercive force of more than 12 kOe and consisting essentially of in atomic percentage, 12.5-14.5% R (provided that R is at least one rare earth element including Y), 5-7% B, and the balance being at least 78.5% Fe and wherein at least 80% of the entire R is Nd and/or Pr and wherein the magnet has coercive force greater than a magnet with the same composition which is in an as-sintered state or which has been subjected to a one-stage aging treatment.

21. An anisotropic sintered permanent magnet having an energy product of at least 35 MGOe and coercive force of more than 12 kOe, and consisting essentially of, in atomic percentage, 12.5-14.5% R (provided that R is at least one rare earth element including Y), 5-7% B, no more than 15% Co (except for 0% Co), and the balance being at least 63.5% Fe, wherein at least 80% of the entire R is Nd and/or Pr and wherein the magnet has coercive force greater than a magnet with the same composition which is in an as-sintered state or which has been subjected to a one-stage aging treatment.

22. An anisotropic sintered permanent magnet having an energy product of at least 35 MGOe and coercive force of more than 12 kOe, and consisting essentially of, in atomic percentage, 12.5-14.5% R (provided that R is at least one rare earth element including Y and at least 80% of the entire R is Nd and/or Pr), 5-7% B, no more than 1% of at least one of the additional elements M (except for 0% M) wherein M is V, Nb, Ta, Mo, W, Cr, Al, Ti, Zr, Hf, Mn, Ni, Ge, Sn, Bi, Sb, Si and Zn and the balance being at least 77.5% Fe and wherein the magnet has coercive force greater than a magnet with the same composition which is in an as-sintered state or which has been subjected to a one-stage aging treatment.

23. An anisotropic sintered permanent magnet having an energy product of at least 35 MGOe and coercive force of more than 12 kOe, and consisting essentially of, in atomic percentage, 12.5-14.5% R (provided that R is at least one rare earth element including Y and at least 80% of the entire R is Nd and/or Pr), 5-7% B, no more than 15% Co (except for 0% Co), no more than 1% of at least one of the additional elements M (except for 0% M) wherein M is V, Nb, Ta, Mo, W, Cr, Al, Ti, Zr, Hf, Mn, Ni, Ge, Sn, Bi, Sb, Si and Zn and the balance being at least 62.5% Fe wherein the magnet has coercive force greater than a magnet with the same composition which is in an as-sintered state or which has been subjected to a one-stage aging treatment.

24. A permanent magnet as defined in any one of claims 9–11 and 20–23, which has an energy product of at least about 36 MGOe.

25. An anisotropic sintered permanent magnet having an energy product of at least 40 MGOe and consisting essentially of in atomic percentage, 13–14.5% R (provided that R is at least one rate earth element including Y, and at least 80% of the entire R is Nd and/or Pr), 6–7% B, and the balance being Fe.

26. An anisotropic sintered permanent magnet having an energy product of at least 40 MGOe and consisting essentially of, in atomic percentage, 13–14.5% R (provided that R is at least one rare earth element including Y and at least 80% of the entire R is Nd and/or Pr), 6–7% B, 0.1–10% Co and the balance being Fe.

27. An anisotropic sintered permanent magnet having an energy product of at least 40 MGOe and consisting essentially of, in atomic percentage, 13–14.5% R (provided that R is at least one rare earth element including Y and at least 80% of the entire R is Nd and/or Pr), 6–7% B, 0.1–1% of at least one of the additional elements M wherein M is V, Nb, Ta, Mo, W, Cr, Al, Ti, Zr, Hf, Mn, Ni, Ge, Sn, Bi, Sb, Si and Zn, and the balance being Fe.

28. An anisotropic sintered permanent magnet having an energy product of at least 40 MGOe and consisting essentially of, in atomic percentage, 13–14.5% R (provided that R is at least one rare earth element including Y and at least 80% of the entire R is Nd and/Pr), 6–7% B, 0.1–10% Co, 0.1–1% of at least one of the additional elements M wherein M is V, Nb, Ta, Mo, W, Cr, Al, Ti, Zr, Hf, Mn, Ni, Ge, Sn, Bi, Sb, Si and Zn, and the balance being Fe.

29. A permanent magnet as defined in any one of claims 25–28, which has an energy product of at least 44 MGOe.

30. A permanent magnet as defined in any one of claims 25–28, which has a coercive force of at least 10 kOe.

* * * * *